US005105512A

United States Patent [19]

Aussedat

[11] Patent Number: 5,105,512

[45] Date of Patent: Apr. 21, 1992

[54] SLIDING CLOSURE

[75] Inventor: Franck Aussedat, Annecy Le Vieux, France

[73] Assignee: Salomon S.A., Chavanod, France

[21] Appl. No.: 634,531

[22] Filed: Dec. 27, 1990

[30] Foreign Application Priority Data

Dec. 29, 1989 [FR] France ..... 89 17550

[51] Int. Cl.[5] ..... A44B 19/26

[52] U.S. Cl. ..... 24/429; 24/419

[58] Field of Search ..... 24/429, 419, 420, 421, 24/425, 427, 428, 435, 437, 448

[56] References Cited

U.S. PATENT DOCUMENTS 2,262,188 11/1941 Marinsky ..... 24/419
2,736,079 2/1956 Staller et al. ..... 24/429
3,952,379 4/1976 Fukuroi ..... 24/425
3,955,248 5/1976 Akashi ..... 24/429
4,662,036 5/1987 Frohlich ..... 24/421
4,823,447 4/1989 Akashi ..... 24/419

FOREIGN PATENT DOCUMENTS 0201419 11/1954 Australia ..... 24/419

*Primary Examiner*—Victor N. Sakran
*Attorney, Agent, or Firm*—Pollock, Vande Sande & Priddy

[57] ABSTRACT

A device for manipulating a zipper comprising a slider with a base and a handle to which a pull is fastened. The pull is made of plastic and has portions which are so dimensioned that, when they contact the base and the handle of the slider, they are momentarily deformed, enabling the pull to pivot on the handle and subsequently to return to a stable position.

10 Claims, 3 Drawing Sheets

SLIDING CLOSURE

FIELD OF THE INVENTION

The present invention concerns zipper closures, and relates more especially to a pull for manipulating a slider belonging to such zipper, which equips, in particular, an article capable of movement.

BACKGROUND OF THE INVENTION

On articles which, by their nature, are subject to regular, repetitive, or accidental movements, e.g., shoes, articles of clothing, portable bags, etc. fitted with conventional zipper closures, the pull used to manipulate the slider is subject to undesirable, noisy rolling, and is capable of catching on or bumping into external objects with which it may accidentally come into contact.

To overcome these difficulties, attempts have therefore been made to impart to the pull of the slider one or several stable positions whenever the pull is not manipulated, thus preventing it from rolling and allowing the pull to be held in a position which avoids undesirable contact with external obstacles.

It has thus been proposed to equip the slider pull and the corresponding part of the article carrying the closure with a catch device, for example of the buckle-and-hook type, sometimes known as "velcro." Besides the fact that this solution can be implemented only for a single end closing position and not for several successive discrete positions, and is applicable even less in a continuous arrangement, it requires additional cutting, sewing, and stitching operations which entail costs that are very high, if not prohibitive.

A device has also been proposed comprising, beneath the handle of the slider to which the pull is securely connected, a spring blade which exerts stress on the end of the pull so as to immobilize it in one or several stable positions with respect to the handle. This solution which, when compared with the preceding one, has the advantage of not depending on the momentary position of the slider along the slide track, is also very costly and not very reliable in relative terms, especially when the number of components and the problems of assembly and wear are considered.

Yet another solution, which, however, is applicable only to zippers in which complementary racks fit into each other, calls for fitting the pull with a hook which, when the pull is pressed down on the slide track only in the closing position, cooperates when engaged between the teeth of the racks to block any translational movement of the pull and the slider in this flattened position, for as long as any external action does not release it from this position. Because of problems of wear, and in order for it to remain reliable after a reasonable number of handling operations, the pull must be made of metal; furthermore, it damages to a greater or lesser extent the teeth of the racks with which it becomes engaged so as to effect immobilization, an arrangement which obviously affects their life.

SUMMARY OF THE INVENTION

The present invention seeks to overcome the difficulties or insufficiencies of the state of the art which have just been mentioned, by proposing for a zipper, whether or not equipped with racks, a device comprising a pull-equipped slider, in which the pull, whatever the position of the slider along the zipper, may, with respect to the slider itself, be immobilized in at least one stable position, in particular in an effaced position, by being pressed down on the zipper, without making use of known state-of-the-art arrangements and thus avoiding the difficulties associated with them.

BRIEF DESCRIPTION OF THE DRAWINGS

The characteristics and advantages of the invention will emerge from the following description, for the understanding of which reference will be made to the drawings, in which.

DESCRIPTION OF THE PREFERRED EMBODIMENT

Figure 1:
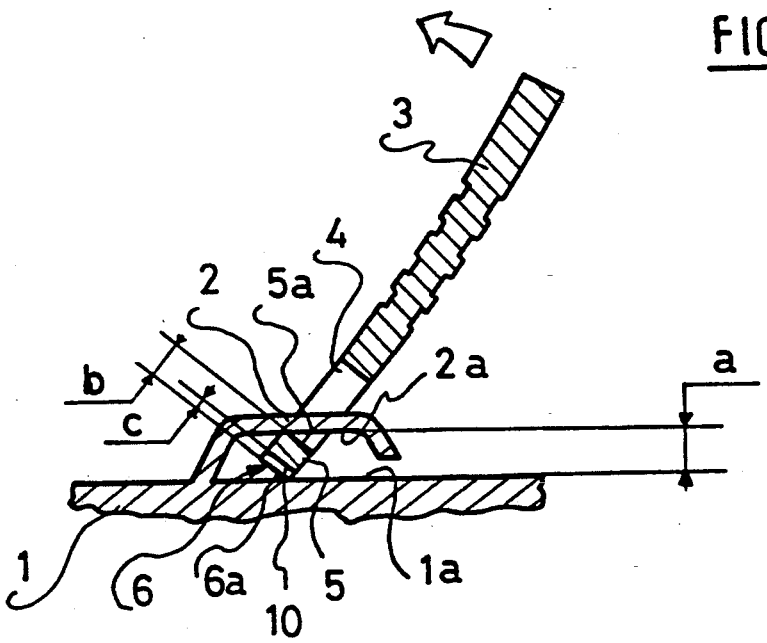
FIG. 1 is a longitudinal axial section of a part of a slider equipped with a handle cooperating with a pull according to the invention.
Figure 2:
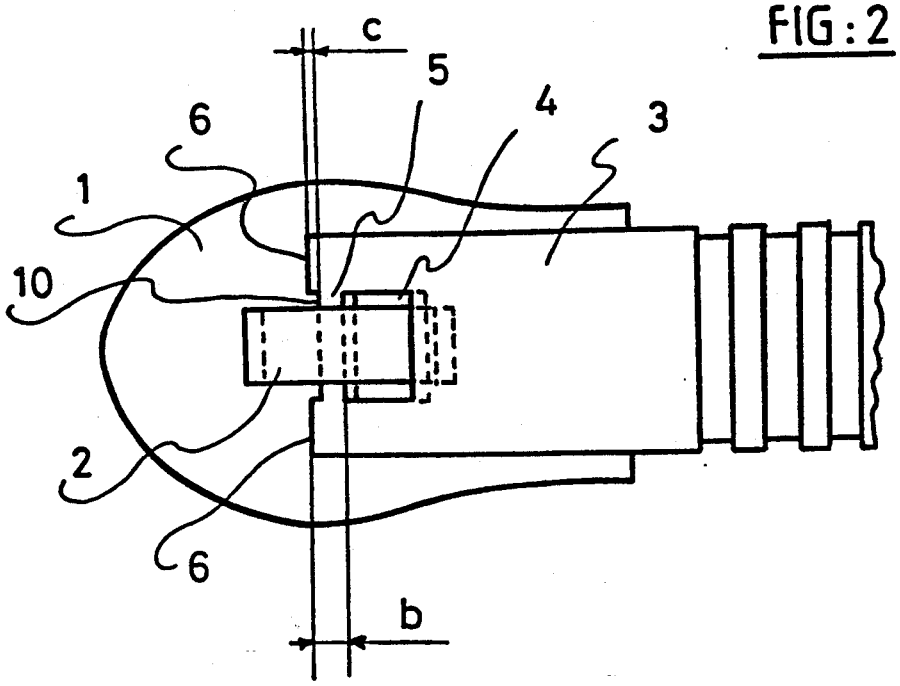
FIG. 2 is a top view on an enlarged scale corresponding to the section in FIG. 1.

According to the present invention, the zipper closure, and especially the slider 1 associated with it, may be of any conventional type, the base of the slider 1 cooperating with the slide tracks or racks (not shown), and this slider 1 having a handle 2 to which a pull 3 is fastened for manipulating this slider 1.

As already described, without provision of additional parts on the pull 3 or the slider 1 and possibly by cooperating with supplementary external parts, the invention seeks to provide for the pull 3 at least one stable position, in particular an effaced position which prevents it from rolling.

This position is ensured by the creation of at least one "hard" or resistance point having an upper stress threshold and which establishes contact between the part of the pull 3 cooperating with the handle 2 and the base of the slider 1 at the level of the handle 2.

As shown by the drawings, the lower end of the pull 3, which has a conventional overall shape, i.e., that of a rectangular parallelepiped, is provided with an aperture 4 having a conventional, approximately rectangular shape through which the handle 2 passes with play sufficient for the manipulation of the pull 3 longitudinally in either direction so as to move the slider 1 along its slide track. The lower edge of this aperture 4 is separated from the end 6*a* of the pull 3 by a solid part 5 over a length of the pull referenced as b in longitudinal direction L. According to the invention, this distance b is slightly greater than distance a separating the lower edge 2*a* of the handle 2 from the base 1*a* of the slider 1. Thus, when pressed down in rest position on either side of the slider 1 along the slide track, the pull 3 is no longer free to pivot around an axis transverse to the handle 2, and its effaced position is thus stable by virtue of the existence of the resistance point in the longitudinal direction of the pull in relation to the handle, resulting from the greater dimension of distance b as compared with distance a.

It will be noted that the resistance point is obtained by the cooperation of the surfaces 5*a*, 6*a* of the pull with the surfaces 2*a* and 1*a*, respectively, of the handle and the slider.

The end of the pull 3 and/or the handle 2 must, therefore, necessarily be made of a material whose elasticity is sufficient so that, because of momentary deformation caused by the manipulation stress exerted by the user, the pull 3 can pivot on the handle 2. Once the action exerted by the user has been completed, the elasticity will, depending on the position of release, bring the pull 3 back into the stable position either in front of or behind the slider 1, or else it will leave it balanced in its median intermediate position, i.e., perpendicular to the base of the slider 1. Thus, without any special indexing device, at least three stable positions of the pull 3 in relation to the slider 1 are obtained, in particular two effaced positions, in which the pull 3 is completely immobilized in relation to the slider 1. It is obvious that the intermediate stable, uneffaced position is less advantageous in use, but may nevertheless offer advantages during zipper assembly operations, for example, or for other less conventional handling operations or uses.

For greater ease of manufacture and, therefore, for reasons of cost, advantage is gained by imparting the required elasticity not to the handle 2, but rather to the pull 3, at least to its end cooperating with the handle 2 and the base of the slider 1.

However, if frequent handling is required, depending on the article in question carrying the zipper and also depending on environmental, especially climatic, conditions in which these operations are to be performed, one may encounter untimely cases of pressing or jamming which may lead to damage rendering the closure device virtually unusable. Furthermore, even excluding extreme situations, problems involving the wear of surfaces in contact may ultimately be encountered which, while not necessarily damaging the functioning of the closure, will no longer enable the pull 3 to maintain its stable effaced positions.

Thus, according to one preferred embodiment, action is undertaken to promote and manage the elasticity phenomenon described above.

For this purpose, the solid part 5 of the pull 3 separating the aperture 4 from the lower end 6*a* of the pull has, in the area of this aperture 4 and excluding the lateral edges 6, in relation to dimension b, an indentation 10 constituting a reduced dimension c (best seen in FIG. 3), such that the reduced dimension b-c is in all cases less than, or at most equal to, distance a which is delimited by the handle 2. Thus, the solid part 5 forms a deformation beam which, during manipulation, will facilitate the elastic spacing of the lateral edges 6 of the end of the pull 3, and will prevent them from being crushed and thus worn against the base of the slider 1. Thus, elastic deformation is favored over crushing and the resulting wear caused by friction. The two lateral edges 6 continue nonetheless, in the absence of manipulation, to fulfill their function of delimiting the stable positions of the pull 3 in relation to the handle 2 of the slider 1.

Because the invention dictates the choice of a sufficiently elastic and strong material for the pull 3, and thus, advantageously, of a modern plastic material, it is possible to profit from these mechanical qualities, so as to gain an additional advantage while remaining within the scope of the invention, as will now be described.

Conventional slider pulls are, as already stated, rigid and thus capable only of negligible deformation, torsion, and flexion. When torsion and flexion are exerted, this stiffness causes tearing of the handle or deterioration of critical parts of the pull, especially when the zippers are distant or slightly, virtually or easily accessible to the user, and sometimes in extreme conditions, for example, in winter sports boots for which gripping with gloves is not easily accomplished.

To limit these effects of torsion and flexion, i.e., to limit the stresses on the handle, conventional practice calls for making the pull extremely small, which still makes manipulation difficult with gloved hands.

According to the invention, the elasticity of the material used is adjusted so as to reduce to a virtually negligible degree the transmission of torque and flexion stresses on the handle, and simultaneously, to impart to the pull a larger section and more generally, larger dimensions, especially as regards length, while increasing both its durability and ease of gripping of the pull, even with a gloved hand.

Figure 3:
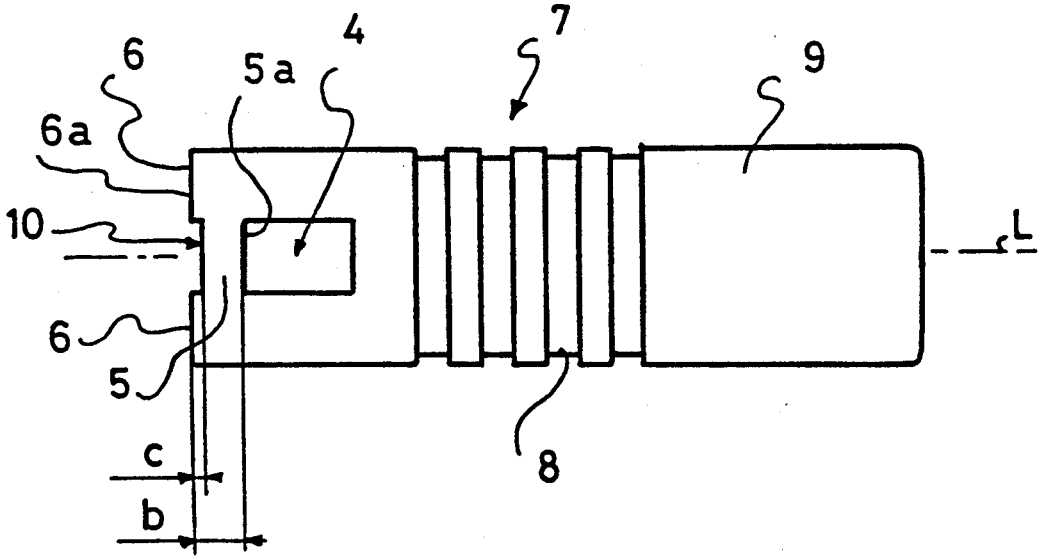
FIG. 3 is a top elevation view of the pull in the preceding Figures, not mounted on the slider.
Figure 4:
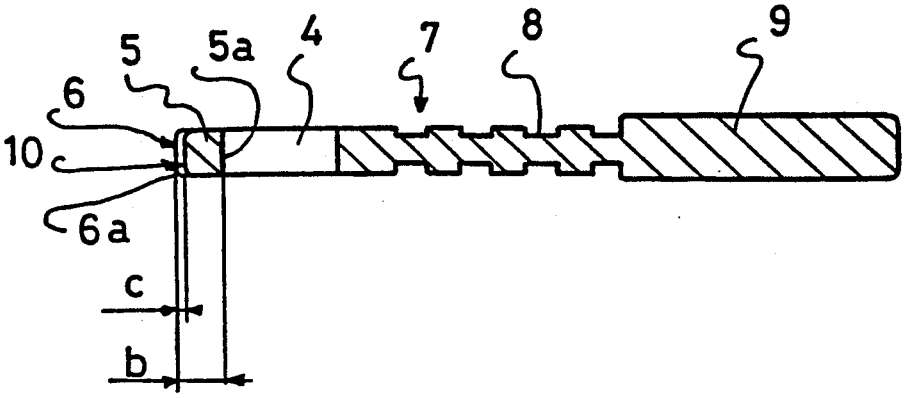
FIG. 4 is a longitudinal axial section corresponding to FIG. 3.

For this purpose, the pull is fitted, between its already described zone of cooperation with the handle 2 and its gripping zone 9 (shown in FIGS. 3 and 4), with an intermediate zone 7 which absorbs torsion and flexion forces and deformations. This privileged deformation zone 7 is composed of at least one, and preferably several, reductions of section 8 which affect either its width, as regards essentially torsion, or its thickness, as regards flexion, and advantageously, both simultaneously, as shown in FIGS. 3 and 4.

Figure 5:
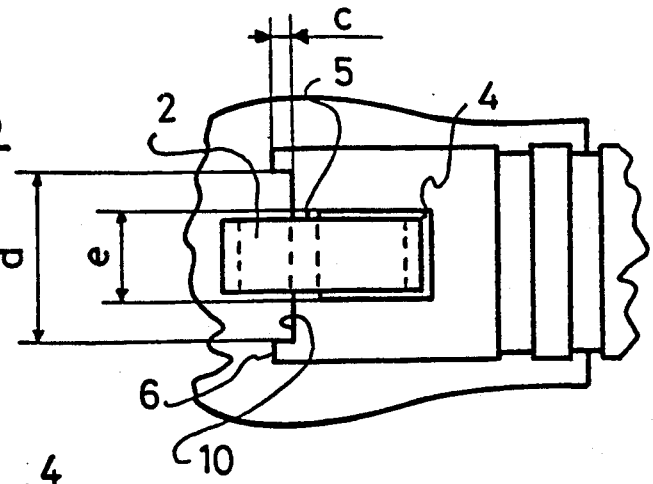
FIGS. 5 and 6 are views similar to that in FIG. 3, representing two different embodiments of the pull.
Figure 6:
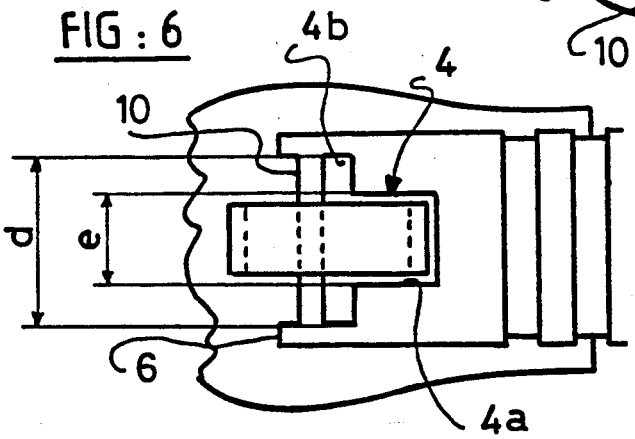

FIGS. 5 and 6 illustrate other embodiments of the pull making it possible to increase the elastic properties of the beam constituted by the solid part 5.

Thus, in FIG. 5, the indentation 10 constituting the reduction of dimension c has, in the plane of the pull, a transverse dimension d greater than the transverse dimension e of the aperture 4, this last dimension e corresponding substantially to the width of the handle 2, so as to allow manipulation of the pull in relation to the handle without excessive play.

This arrangement makes it possible to increase the deformable part of the beam 5 and thereby makes it possible to increase the deformation properties of the latter.

In FIG. 6, the aperture 4 allowing the passage of the handle is substantially T shaped, the narrowest part 4*a* of the aperture having a transverse dimension e corresponding substantially to the width of the handle 2 and whose widest part 4*b* has a transverse dimension d greater than the transverse dimension e.

In this case, the indentation 10 constituting the dimension reduction c has a transverse dimension at least equal to the transverse dimension d of the aperture 4.

This makes it possible to elongate the entirety of the beam 5 and thus to increase its deformation properties.

Other embodiments may, of course, be contemplated in order to increase the deformation properties of the solid part 5 forming the beam.

Figure 7:
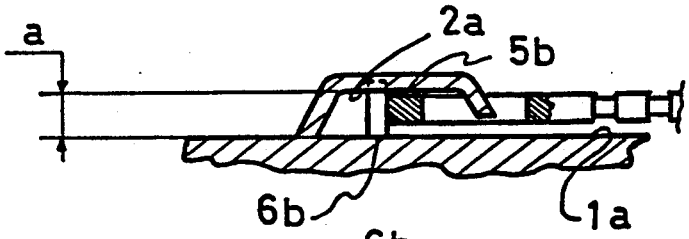
FIG. 7 is a view, similar to FIG. 1, of another embodiment of the pull.
Figure 8:
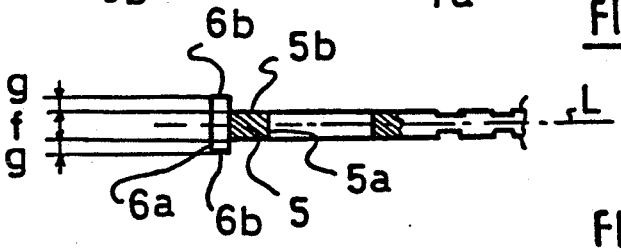
FIG. 8 is a longitudinal axial section view of the pull in FIG. 7.
Figure 9:
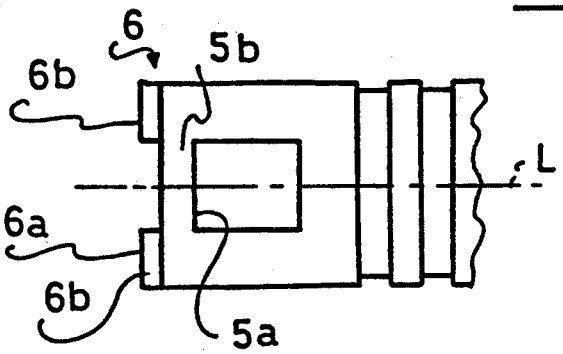
FIG. 9 is a top view of the pull in FIG. 7.

FIGS. 7 to 9 show another embodiment of the pull designed to ensure its total immobilization in relation to the handle in rest position, i.e., in the position in which the pull is pressed down along the slide track.

In fact, although this position is a stable one, the presence of play in the vertical direction between the handle 2 and the pull 3 required for manipulation of the latter may cause slight "pivoting" of the pull, even in the stable position. Complete immobilization of the pull in this position is ensured by the creation of a hard point between the pull and the handle, no longer in the longitudinal direction of the pull as in the case shown in FIGS. 1 to 6, but in a direction transverse to the plane of the pull, and, in this particular case, vertically.

The hard point is obtained by providing, on the lateral edges 6 of the end of the pull 3, bosses 6*b* projecting transversely on either side of surfaces 5*b* of the solid part 5 of the pull.

As shown in FIGS. 7 and 8, each of these bosses 6*b* delimits, in relation to the solid part 5 having a transverse dimension or thickness f, an increased dimension g such that $f+g>a$, dimension f being slightly less than dimension a.

Surfaces 5*b*, 6*b* of the pull, which cooperate with the surfaces 2*a* and 1*a*, respectively, of the handle and of the slider 1, delimit, in conjunction with these latter, a "hard" point extending in the transverse direction of the pull ensuring the complete immobilization of the pull in rest position.

What is claimed is:

1. Device for the manipulation of a zipper closure comprising a slider (1) movable along a slide track and provided with a base (1*a*) and a handle (2) to which is fastened a pull (3) made of a plastic material and capable of pivoting longitudinally in relation to said handle (2), said handle (2) passing through an aperture (4) in said pull (3) separated from an end of said pull by a solid part (5) of said pull, said device comprising at least one hard point of contact between a first part (5*a*, 5*b*) of said pull cooperating with said handle (2) and a second part (6*a*, 6*b*) of said pull cooperating with said base (1*a*) of said slider, said hard point of contact being created by provision of a distance (b, $f+g$) between said first and second parts (5*a*, 5*b*; 6*a*, 6*b*) of said pull greater than a distance (a) between an inner edge of said handle (2) and said base (1*a*) of said slider, whereby said parts (5*a*, 5*b*; 6*a*, 6*b*) are momentarily deformed when in contact with said handle (2) and said base (1*a*) of said slider.

2. Device according to claim 1, wherein said hard point of contact is created in a longitudinal direction (L) of said pull.

3. Device according to claim 2, wherein said end of said pull (3) is located beneath said handle (2) and beyond said aperture (4) and is made of an elastic material, and wherein an edge (4*a*) of said aperture (4) is separated from said end of said pull (3) by a distance (b) which is slightly greater than said distance (a) between said inner edge (2*a*) of said handle (2) and said base (1*a*) of said slider (1).

4. Device according to claim 3, wherein said solid part (5) separating said aperture (4) from said end of said pull (3) has, in the area of said aperture (4), a dimension (c) which is less than said distance (b) by an amount smaller than said distance (a).

5. Device according to claim 4, wherein said solid part (5) of said pull comprises at least one side having a dimension (d) greater than a transverse dimension (e) of said aperture (4).

6. Device according to claim 5, wherein said solid part (5) comprises two sides having a dimension (d) greater than said transverse dimension of said aperture (4).

7. Device according to claim 1, wherein said hard point is created in a direction of said pull perpendicular to a plane of said pull.

8. Device according to claim 7, wherein said solid part (5) has a thickness (f), and wherein said pull comprises, on at least one lateral edge (6) of said pull, at least one projecting boss (6*b*) delimiting, in relation to said thickness (f), an increased dimension (g) such that said increased dimension ($f+g$) is greater than said distance (a) between said inner edge of said handle (2) and said base (1*a*) of said slider.

9. Device according to claim 1, wherein said pull (3) comprises an intermediate zone (7) which absorbs flexion and torsion forces and deformation exerted by a user of said device.

10. Device according to claim 9, wherein said intermediate zone (7) has at least one reduced section (8) affecting at least one of its width and thickness.

* * * * *